US005504998A

United States Patent [19]

Nguyen

[11] Patent Number: 5,504,998

[45] Date of Patent: Apr. 9, 1996

[54] MANUAL CUTTING WHEEL

[76] Inventor: Thuthuy C. Nguyen, 21932 E. Sorrel Ct., Walnut, Calif. 91789

[21] Appl. No.: 303,686

[22] Filed: Sep. 9, 1994

[51] Int. Cl.[6] ..... B26B 27/00

[52] U.S. Cl. ..... 30/319; 30/307

[58] Field of Search ..... 30/307, 319, 306, 30/314, 315

[56] References Cited

U.S. PATENT DOCUMENTS 677,337 7/1901 Cameron ..... 30/307

2,526,154 10/1950 Parks ..... 30/307 X 4,809,437 3/1989 Saliaris ..... 30/307 X

FOREIGN PATENT DOCUMENTS 713459 9/1931 France ..... 30/307

*Primary Examiner*—Douglas D. Watts

[57] ABSTRACT

A rotating cutter for cutting pizza or other planar objects. The inventive device includes a substantially U-shaped handle with a rotating cutting wheel mounted to the base of the handle. The handle is oriented relative to the cutting wheel such that a downward force can be applied to the wheel during a cutting procedure.

5 Claims, 4 Drawing Sheets

FIG. 3
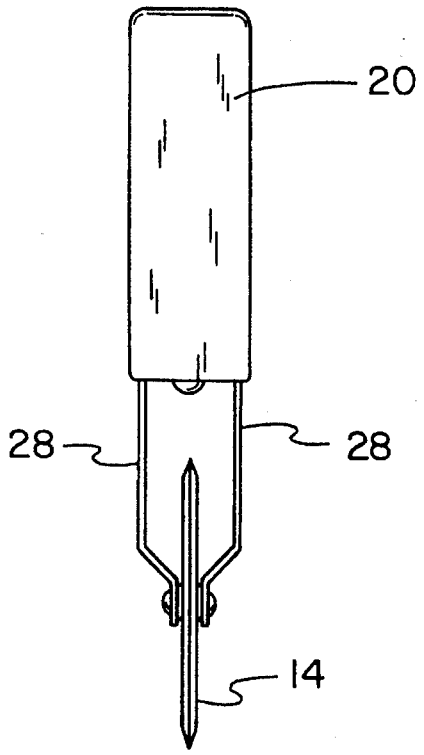
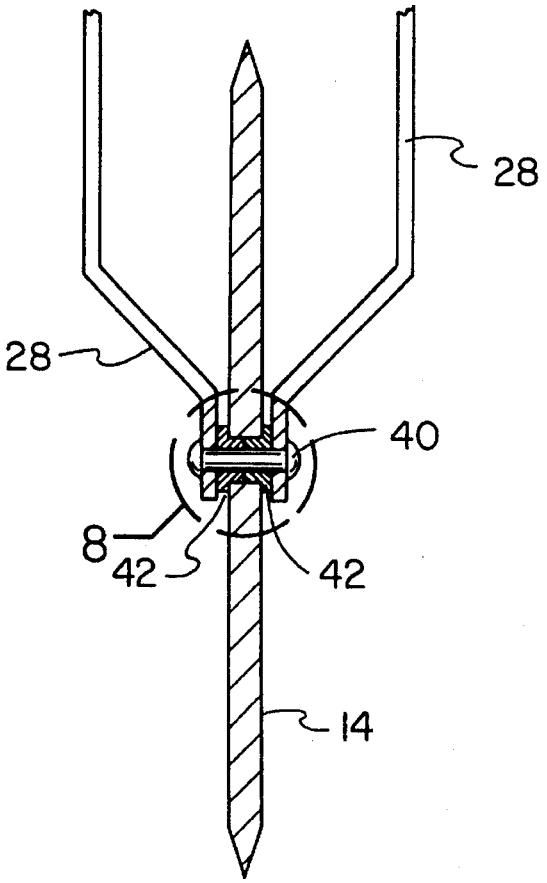
FIG. 4

FIG. 5
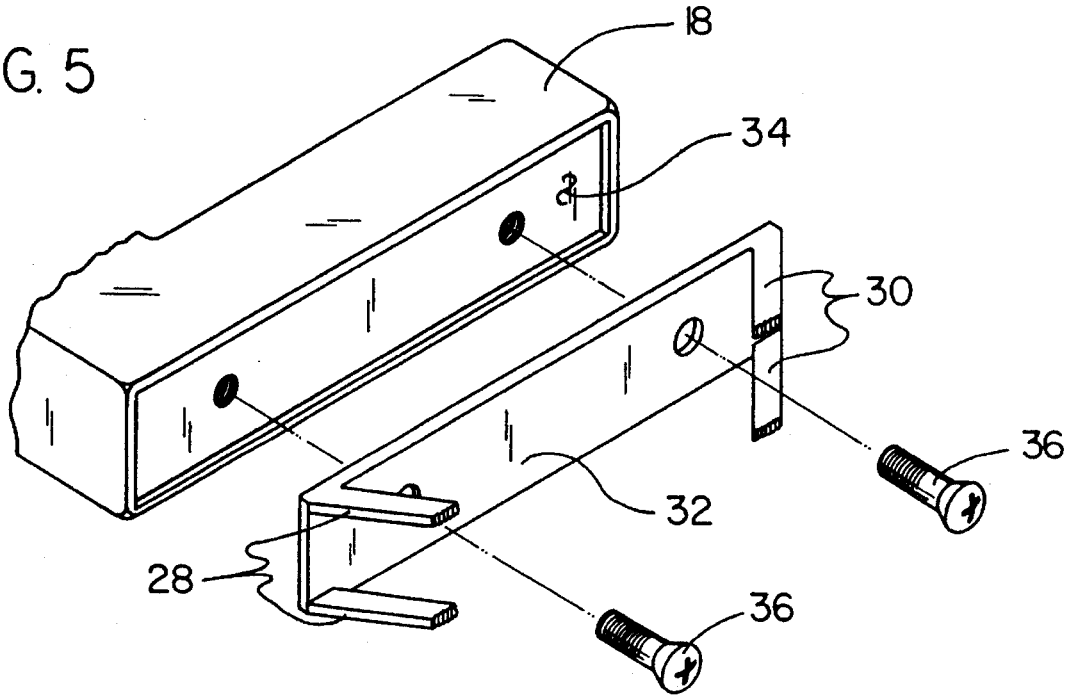
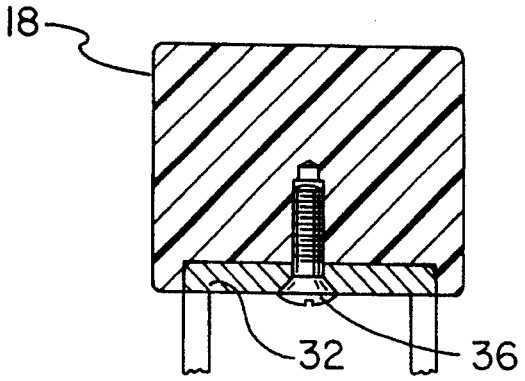
FIG. 6

MANUAL CUTTING WHEEL

BACKGROUND OF THE INVENTION

1. Field of the Invention

The present invention relates to cutting structures and more particularly pertains to a manual cutting wheel for cutting pizza or other planar objects.

2. Description of the Prior Art

The use of cutting structures is known in the prior art. More specifically, cutting structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art cutting structures include U.S. Pat. No. 4,738,028; U.S. Pat. No. 4,574,479; U.S. Pat. No. 4,250,618; U.S. Pat. No. 3,639,981; and U.S. Design Pat. No. 321,112.

While these devices fulfill their respective, particular objectives and requirements, the aforementioned patents do not disclose a manual cutting wheel for cutting pizza or other planar objects which includes a substantially U-shaped handle with a rotating cutting wheel mounted to the base of the handle, wherein the handle is oriented relative to the cutting wheel such that a downward force can be applied to the wheel during a cutting procedure.

In these respects, the manual cutting wheel according to the present invention substantially departs from the conventional concepts and designs of the prior art, and in so doing provides an apparatus primarily developed for the purpose of cutting pizza or other planar objects.

SUMMARY OF THE INVENTION

In view of the foregoing disadvantages inherent in the known types of cutting structures now present in the prior art, the present invention provides a new manual cutting wheel construction wherein the same can be utilized for cutting pizza or other planar objects. As such, the general purpose of the present invention, which will be described subsequently in greater detail, is to provide a new manual cutting wheel apparatus and method which has many of the advantages of the cutting structures mentioned heretofore and many novel features that result in a manual cutting wheel which is not anticipated, rendered obvious, suggested, or even implied by any of the prior art cutting structures, either alone or in any combination thereof.

To attain this, the present invention generally comprises a rotating cutter for cutting pizza or other planar objects. The inventive device includes a substantially U-shaped handle with a rotating cutting wheel mounted to the base of the handle. The handle is oriented relative to the cutting wheel such that a downward force can be applied to the wheel during a cutting procedure.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new manual cutting wheel apparatus and method which has many of the advantages of the cutting structures mentioned heretofore and many novel features that result in a manual cutting wheel which is not anticipated, rendered obvious, suggested, or even implied by any of the prior art cutting structures, either alone or in any combination thereof.

It is another object of the present invention to provide a new manual cutting wheel which may be easily and efficiently manufactured and marketed.

It is a further object of the present invention to provide a new manual cutting wheel which is of a durable and reliable construction.

An even further object of the present invention is to provide a new manual cutting wheel which is susceptible of a low cost of manufacture with regard to both materials and labor, and which accordingly is then susceptible of low prices of sale to the consuming public, thereby making such manual cutting wheels economically available to the buying public.

Still yet another object of the present invention is to provide a new manual cutting wheel which provides in the apparatuses and methods of the prior art some of the advantages thereof, while simultaneously overcoming some of the disadvantages normally associated therewith.

Still another object of the present invention is to provide a new manual cutting wheel for cutting pizza or other planar objects.

Yet another object of the present invention is to provide a new manual cutting wheel which includes a substantially U-shaped handle with a rotating cutting wheel mounted to the base of the handle, wherein the handle is oriented relative to the cutting wheel such that a downward force can be applied to the wheel during a cutting procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevation view of the cutting wheel.

FIG. 4 is a cross-sectional view taken along line 4—4 of FIG. 2.

FIG. 5 is an exploded illustration of a portion of the present invention.

FIG. 6 is a cross-sectional view taken along line 6—6 of FIG. 2.

DESCRIPTION OF THE PREFERRED EMBODIMENT

Figure 1:
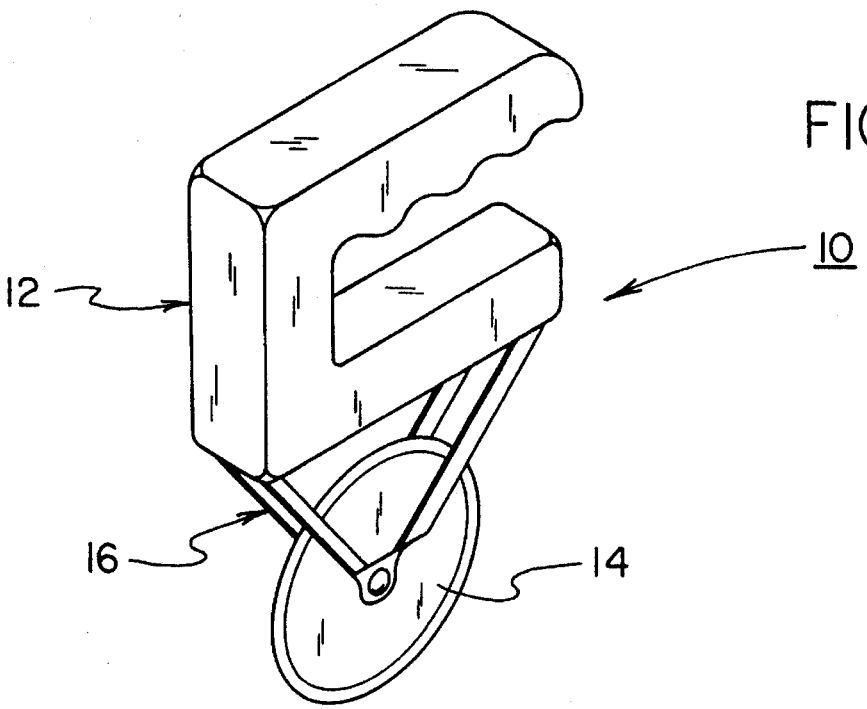
FIG. 1 is an isometric illustration of a manual cutting wheel according to the present invention.

With reference now to the drawings, and in particular to FIGS. 1–8 thereof, a new manual cutting wheel embodying the principles and concepts of the present invention and generally designated by the reference numeral 10 will be described.

Figure 2:
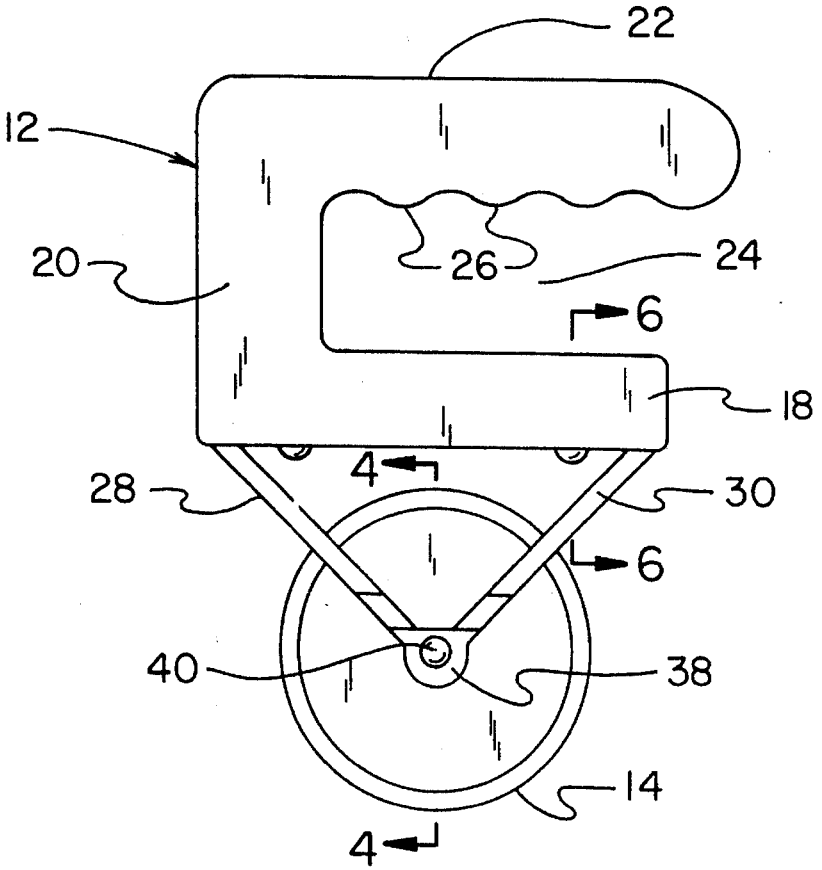
FIG. 2 is a side elevation view thereof.

More specifically, it will be noted that the manual cutting wheel 10 comprises a handle means 12 which may be grasped and manipulated by an individual, a rotating cutting wheel 14 for severing a pizza or other planar objects, and a support means 16 for rotatably coupling the cutting wheel to a lower portion of the handle means, as best illustrated in FIG. 1. The handle means 12, as shown in FIG. 2, comprises a substantially rectangular base member 18 having a longitudinal length substantially slightly greater than a diameter of the cutting wheel 14. A vertical stanchion 20 orthogonally projects from a forward end of the base member 18 to connect with a hand grip 22. The hand grip 22 extends orthogonally from the vertical stanchion 20 into a position parallel to, and substantially spaced from, the base member 18 to define a finger space 24 through which an individual's fingers may extend to wrap about the hand grip 22. Further, the hand grip 22 is provided with a plurality of arcuate contours 26 along a lower surface thereof which cooperate to preclude slipping of an individual's hand along a longitudinal length of the hand grip 22.

Referring now to FIGS. 3 through 6, with concurrent reference to FIG. 2, it can be shown that the support means 12 preferably comprises a pair of spaced forward wheel supports 28 which extend from a forward end of the base member 18, and a pair of rearward wheel supports 30 extending from a rearward end of the base member 18. As shown in FIGS. 5 and 6, the wheel support pairs 28, 30 extend from corners of a mounting plate 32 which is received within a recessed area 34 formed along a bottom side of the base member 18. A plurality of threaded fasteners 36 extend through the mounting plate 32 and are directed into the base member to secure the mounting plate thereto. By this structure, the handle means 12 may be separated from the support means 16 during a cleaning procedure or the like.

Figure 7:
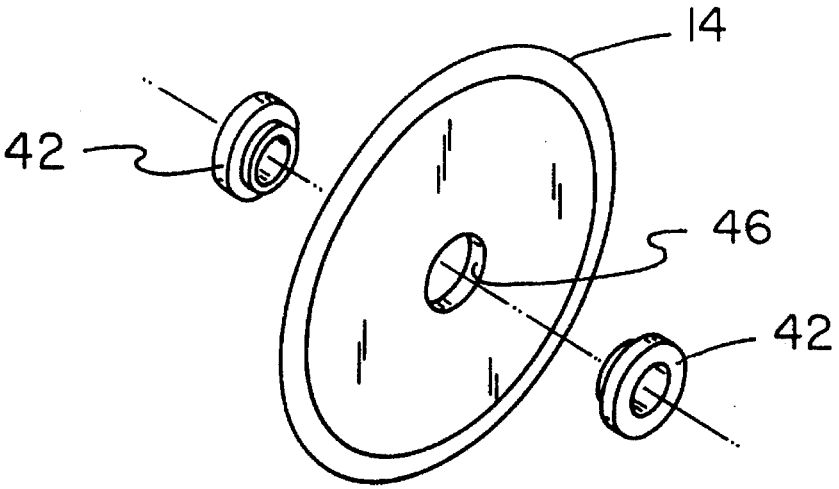
FIG. 7 is an exploded illustration of a further portion of the invention.
Figure 8:
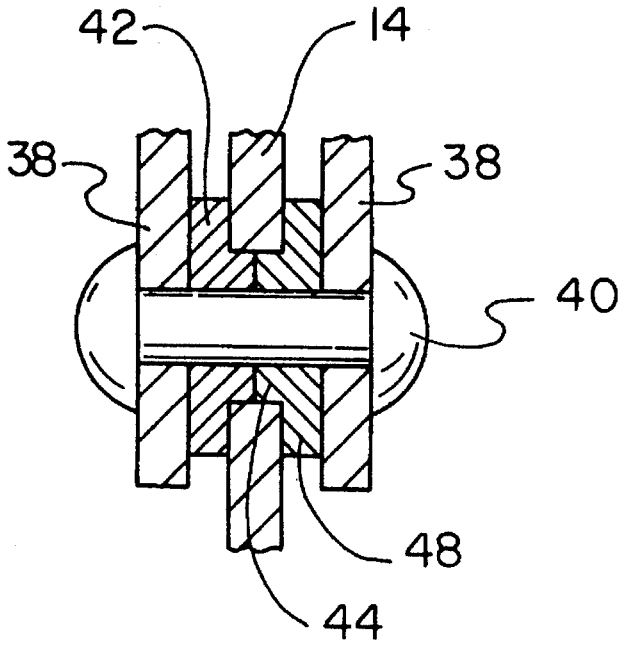
FIG. 8 is an enlarged illustration of the area set forth in FIG. 4.

The forward wheel support pair 28 extends from the forward end of the base member 18 at an oblique angle relative thereto and intersects with the rearward wheel support pair 30 to define a pair of spaced axle mounts 38. The axle mounts 38 are positioned in a substantially spaced, parallel relationship and include aligned and unlabelled through-extending apertures which permit the passage of an axle 40 therethrough. The axle 40 rotatably supports the cutting wheel 14 upon a pair of bushings 42 positioned on either side of the cutting wheel, as shown in FIG. 7 for example. The bushings 42 are more specifically illustrated in FIG. 8, and it can be shown from this figure that each of the wheel bushings 42 comprises a substantially cylindrical vertical force bushing 44 dimensioned to fit within a center aperture 46 of the cutting wheel 14. Further, the bushings each comprise a substantially cylindrical lateral force bushing 48 dimensioned to fit between the axle mounts 38 and the cutting wheel 14. In this respect, the vertical force bushing 44 of each of the wheel bushings 42 is of a first diameter and the lateral force bushing 48 is of a second diameter, wherein the second diameter is substantially larger than the first diameter. By this structure, the vertical force bushing 44 is operable to accommodate vertical forces imparted to the cutting wheel 14 through the handle means 12 and the support means 16, while the lateral force bushing 48 imparts lateral stability to the cutting wheel relative to the support means. Preferably, the wheel bushings 42 are comprised of a low friction material, such as the trademarked material commonly known as "TEFLON".

In use, the manual cutting wheel 10 allows an individual to exert a downward force on the cutting wheel 14 which is substantially perpendicular to the horizontal. Such positioning of the handle means 12 immediately above the cutting wheel 14 permits the application of a downward vertical force perpendicular to the direction of travel of the cutting wheel during the cutting of a pizza or other planar object. Further, because the base member 18 has a longitudinal length greater than the diameter of the cutting wheel 14, unintentional contact of the individual's hand against the sharp edge of the cutting wheel 14 is substantially reduced relative to prior art devices.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A manual cutting wheel comprising:

a handle means for being grasped and manipulated by an individual, said handle means comprising a base member, a vertical stanchion orthogonally projecting from a forward end of said base member, a hand grip extending orthogonally from said vertical stanchion into a position substantially parallel to and spaced from said base member to define a finger space through which an individual's fingers can be positioned to wrap about said hand grip;

a rotating cutting wheel for severing a planar object; and a support means for rotatably coupling said rotating cutting wheel means to said handle means, said support means comprising a mounting plate secured to a bottom side of said base member, a pair of spaced forward wheel supports which extend from a forward end of said base member, a pair of rearward wheel supports extending from a rearward end of said base member, said wheel support pairs extending from corners of a said mounting plate, with said forward wheel support pair extending from said forward end of said base member at an oblique angle relative thereto and intersecting with said rearward wheel support pair to define a pair of spaced axle mounts, said axle mounts being positioned in a substantially spaced, parallel relationship, said axle mounts including aligned through-extending apertures, and an axle extending through a center aperture in said rotating cutting wheel and at least one bushing means interposed between said cutting wheel center aperture and said axle to rotatably support said cutting wheel relative to said axle.

2. The manual cutting wheel of claim 1, wherein said bushing means comprises a pair of bushings positioned on opposed sides of said cutting wheel, each of said bushings comprising a substantially cylindrical vertical force bushing positioned within said center aperture of said cutting wheel; and a substantially cylindrical lateral force bushing coupled to said vertical force bushing and positioned between said axle mounts and said cutting wheel, said vertical force bushing being of a first diameter and said lateral force bushing being of a second diameter, wherein the second diameter is substantially larger than the first diameter. wheel bushings 42 are comprised of a low friction material, such as the trademarked material commonly known as "TEFLON".

3. The manual cutting wheel of claim 2, wherein said base member has a longitudinal length substantially greater than a diameter of said cutting wheel.

4. The manual cutting wheel of claim 3, wherein said hand grip includes a plurality of arcuate contours along a lower surface thereof which cooperate to preclude slipping of an individual's hand along a longitudinal length of said hand grip.

5. A manual cutting wheel comprising:

a rotating cutting wheel for severing planar objects;

a handle means for being grasped and manipulated by an individual, said handle means comprising a base member having a longitudinal length substantially greater than a diameter of said cutting wheel; a vertical stanchion orthogonally projecting from a forward end of said base member; a hand grip extending orthogonally from said vertical stanchion into a position substantially parallel to and spaced from said base member to define a finger space through which an individual's fingers can be positioned to wrap about said hand grip, said hand grip includes a plurality of arcuate contours along a lower surface thereof which cooperate to preclude slipping of an individual's hand along a longitudinal length of said hand grip;

and, a support means for rotatably coupling said rotating cutting wheel means to said handle means, said support means comprising a mounting plate secured to a bottom side of said base member; a pair of spaced forward wheel supports which extend from a forward end of said base member; a pair of rearward wheel supports extending from a rearward end of said base member, said wheel support pairs extending from corners of a said mounting plate, with said forward wheel support pair extends from said forward end of said base member at an oblique angle relative thereto and intersecting with said rearward wheel support pair to define a pair of spaced axle mounts, said axle mounts being positioned in a substantially spaced, parallel relationship, said axle mounts including aligned through-extending apertures; and an axle extending through a center aperture in said rotating cutting wheel; and at least one bushing means interposed between said cutting wheel center aperture and said axle to rotatably support said cutting wheel relative to said axle, said bushing means comprising a pair of bushings positioned on opposed sides of said cutting wheel, each of said bushings comprising a substantially cylindrical vertical force bushing positioned within said center aperture of said cutting wheel; and a substantially cylindrical lateral force bushing coupled to said vertical force bushing and positioned between said axle mounts and said cutting wheel, said vertical force bushing being of a first diameter and said lateral force bushing being of a second diameter, wherein the second diameter is substantially larger than the first diameter, said bushings being comprised of a fluorocarbon polymer.

* * * * *